US011452364B1

(12) United States Patent
Vanderloo

(10) Patent No.: US 11,452,364 B1
(45) Date of Patent: Sep. 27, 2022

(54) SANDAL TRANSPORT DEVICE

(71) Applicant: Ann Vanderloo, Eagan, MN (US)

(72) Inventor: Ann Vanderloo, Eagan, MN (US)

( * ) Notice: Subject to any disclaimer, the term of this patent is extended or adjusted under 35 U.S.C. 154(b) by 194 days.

(21) Appl. No.: 16/892,390

(22) Filed: Jun. 4, 2020

(51) Int. Cl.
*A45F 5/02* (2006.01)
*A43B 3/12* (2006.01)
*A43B 3/10* (2006.01)

(52) U.S. Cl.
CPC ..... *A45F 5/02* (2013.01); *A43B 3/10* (2013.01); *A43B 3/12* (2013.01)

(58) Field of Classification Search
CPC ..... A47G 25/005; A47G 25/32; A45F 5/02; A45F 5/021; A45F 5/102; A45F 5/1026; A45F 2005/1033; A45F 2005/104; A45C 2013/306; A43B 3/10; A43B 3/12; A43D 3/14; A47F 7/08
See application file for complete search history.

(56) References Cited

U.S. PATENT DOCUMENTS 1,516,875 A * 11/1924 Allen ..... F16B 45/02 24/599.6
2,004,284 A * 6/1935 Kellerth ..... A47G 25/52 223/96
2,044,425 A * 6/1936 Freysinger ..... F16B 45/02 59/95
2,956,689 A * 10/1960 Van Der Togt ..... D06F 57/12 211/104
3,172,537 A * 3/1965 Kraft ..... A47F 7/08 211/35
3,342,345 A * 9/1967 Van Dusen ..... A47G 25/743 211/119
3,782,612 A * 1/1974 Barnes ..... A47G 25/24 223/85
4,669,615 A * 6/1987 Zigman ..... A47G 25/005 211/119
D324,782 S * 3/1992 Pedersen ..... D6/318
D368,167 S * 3/1996 Zeri ..... D6/327
5,649,653 A * 7/1997 Joseph ..... A47G 25/32 223/92
7,775,410 B2 * 8/2010 Zamzow ..... A47G 25/005 211/34
7,837,074 B2 * 11/2010 Rude ..... A47G 25/32 223/94
8,714,370 B2 * 5/2014 Jebara ..... F16B 2/12 223/85
D707,455 S * 6/2014 Goodman ..... D6/317
8,915,384 B2 * 12/2014 Immerman ..... A47G 25/0614 211/119
9,414,702 B2 * 8/2016 Merandi ..... A47F 7/19
9,930,984 B1 * 4/2018 Holmes ..... A47G 25/28
(Continued)

*Primary Examiner* — Adam J Waggenspack
(74) *Attorney, Agent, or Firm* — Vidas, Arrett & Steinkraus, PA; Richard A. Arrett; Edwin E. Voigt, II

(57) ABSTRACT

A sandal transport device includes a resiliently pliable elongate member having the shape of a "W". The resiliently pliable elongate member has a first elevated end, a first angled section, a first trough, a second angled section, a crest, a third angled section, a second trough, a fourth angled section and a second elevated end. The resiliently pliable elongate member may be engaged to a releasable clip, and the releasably pliable elongate member is constructed and arranged for engagement to and the transportation of footwear.

14 Claims, 6 Drawing Sheets

(56) References Cited

U.S. PATENT DOCUMENTS

| | | | | |
|---|---|---|---|---|
| 2016/0198850 | A1* | 7/2016 | Wall | A47F 7/08 211/36 |
| 2016/0302559 | A1* | 10/2016 | Khan | A45F 5/022 |
| 2017/0065113 | A1* | 3/2017 | Boles | A47G 25/1442 |
| 2021/0113005 | A1* | 4/2021 | Patay | A47G 29/087 |

* cited by examiner

SANDAL TRANSPORT DEVICE

FIELD OF THE INVENTION

Generally the invention is directed to a "W-shaped" carrier for sandals, flip-flops, or other items. The sandal transport device may be releasably secured to shorts, a bathing suit, a cover-up, pants or another clothing item, through the use of a releasable clasp or clip. The sandal transport device may be formed of pliable and resilient rubber material which will retain the "W-shape" following initial manufacture, or through bending by an individual. The sandal transport device may be formed of material having any desired color.

BACKGROUND

In the past individuals walking on the beach without footwear, such as sandals or flip-flops, were required to carry the sandals or flip-flops in an individual's hands, or in a bag. During walking activities on a beach, an individual will frequently desire to use an electronic device, one example of which is a cellular telephone. Use of a cellular telephone will frequently require use of both of an individual's hands. The transportation and use of an electronic device or cellular telephone during walking on the beach while carrying footwear is difficult, which in turn may result in the dropping of the electronic device or cellular telephone causing damage.

Individuals frequently carry sandals or flip-flops while walking on the beach because the individual plans on leaving the beach to walk on pavement, or to enter a restaurant or other facility, where the use of the sandals or flip-flops on the individual's feet is preferred or required.

In addition, individuals walking on a beach with children experience difficulty in carrying both an individual's sandals or flip-flops as well as a child's sandals or flip-flops, while simultaneously attempting to use an electronic device. No device is known to conveniently carry or transport sandals or flip-flops during use of an electronic device while an individual walks on a beach.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entireties.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

The sandal transport device includes a resiliently pliable elongate member, where the resiliently pliable elongate member is formed into the shape of a "W". The resiliently pliable elongate member includes a first elevated end, a first angled section, a first trough, a second angled section, a crest, a third angled section, a second trough, a fourth angled section and a second elevated end. The resiliently pliable elongate member is constructed and arranged for engagement with a releasable clip. The resiliently pliable elongate member is constructed and arranged for releasable engagement to footwear and the releasable clip is constructed and arranged for releasable attachment to an article of clothing.

The first elevated end may include a first cap and the second elevated end may include a second cap.

In one embodiment the resiliently pliable elongate member is formed of at least one material selected from the group consisting of rubber, plastic, metal, composite materials and/or combinations thereof. The resiliently pliable elongate member also includes an exterior surface which may be textured.

In at least one embodiment the releasable clip is releasably engaged to the crest of the "W" shaped resiliently pliable elongate member and is further releasably engaged to an article of clothing.

In one embodiment the first trough is positioned between the first angled section and the second angled section, and the second trough is positioned between the third angled section and the fourth angled section.

In some embodiments the resiliently pliable elongate member is formed of wire coated with rubber or plastic material or wire coated with a combination of rubber and plastic material.

In one embodiment the first trough has the shape of a rounded point, the crest has the shape of a rounded point and the second trough has the shape of a rounded point. In another embodiment the first trough is curved in a first direction and includes a first arc dimension, and the second trough is curved in the first direction and has the first arc dimension. In another embodiment the arc dimension for the first trough and the second trough are not identical. In addition, the crest is curved in a second direction, where the second direction is opposite to the first direction.

In another embodiment the first angled section has a first angle relative to the first trough, the first angle having a first angle dimension between vertical and forty-five degrees. The second angled section has a second angle relative to the first trough, the second angle has a second angle dimension between vertical and one hundred thirty five degrees. The third angled section has a third angle relative to the second trough, the third angle has a third angle dimension between vertical and forty-five degrees. The fourth angled section has a fourth angle relative to the second trough, the fourth angle having a fourth angle dimension between vertical and one hundred thirty five degrees.

DETAILED DESCRIPTION OF THE PREFERRED EMBODIMENTS

Figure 1:
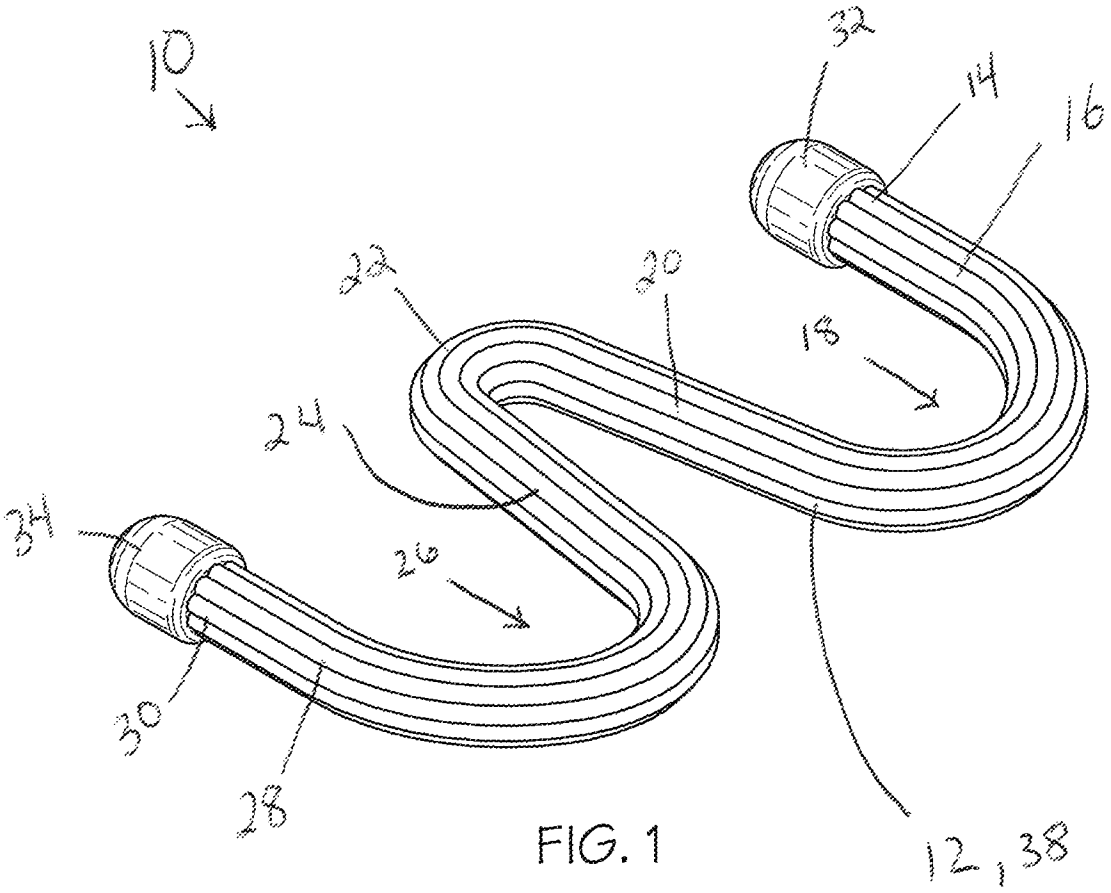
FIG. 1 is an isometric perspective top view of the sandal transport device.
Figure 2:
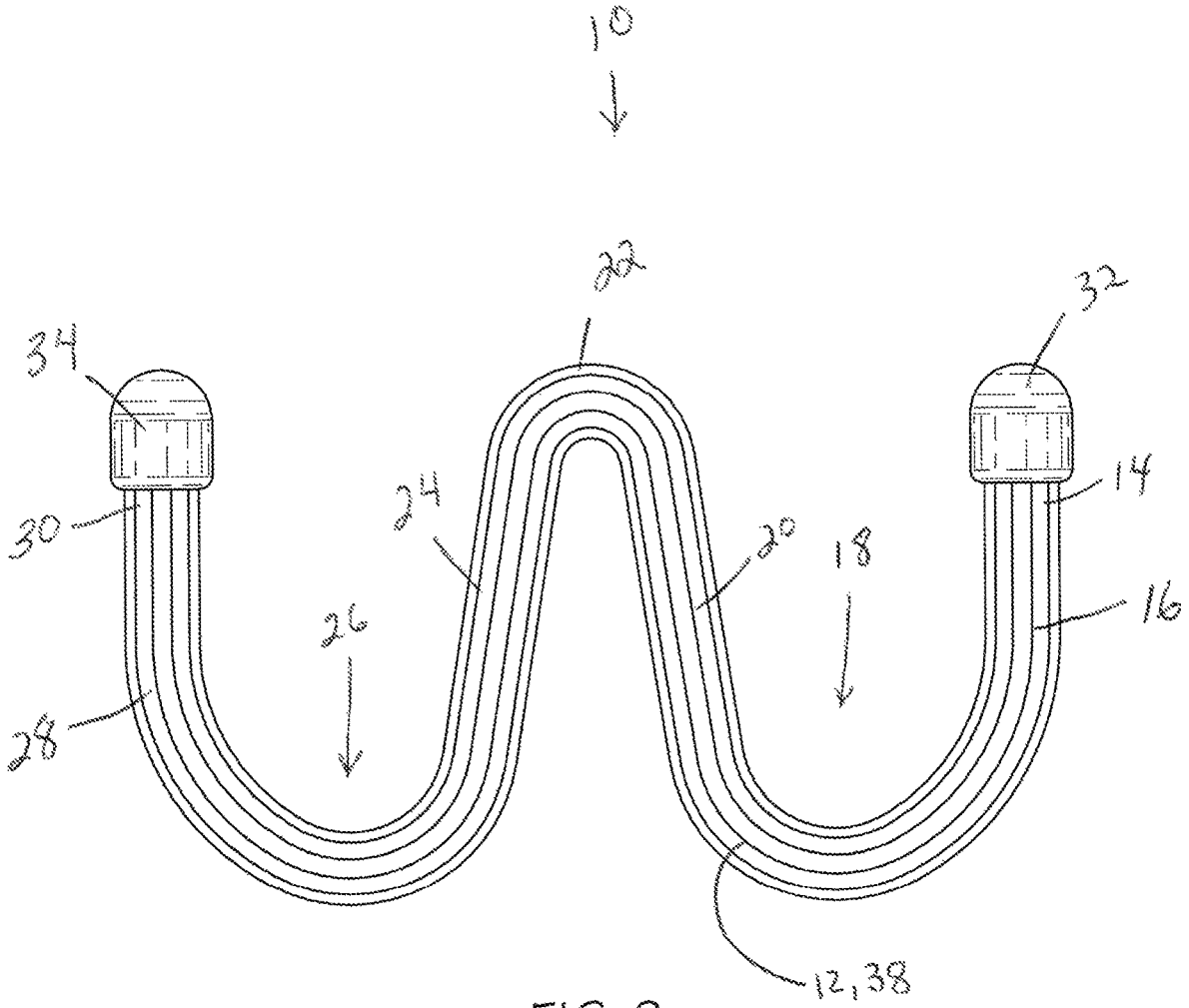
FIG. 2 is front elevation view of the sandal transport device.
Figure 3:
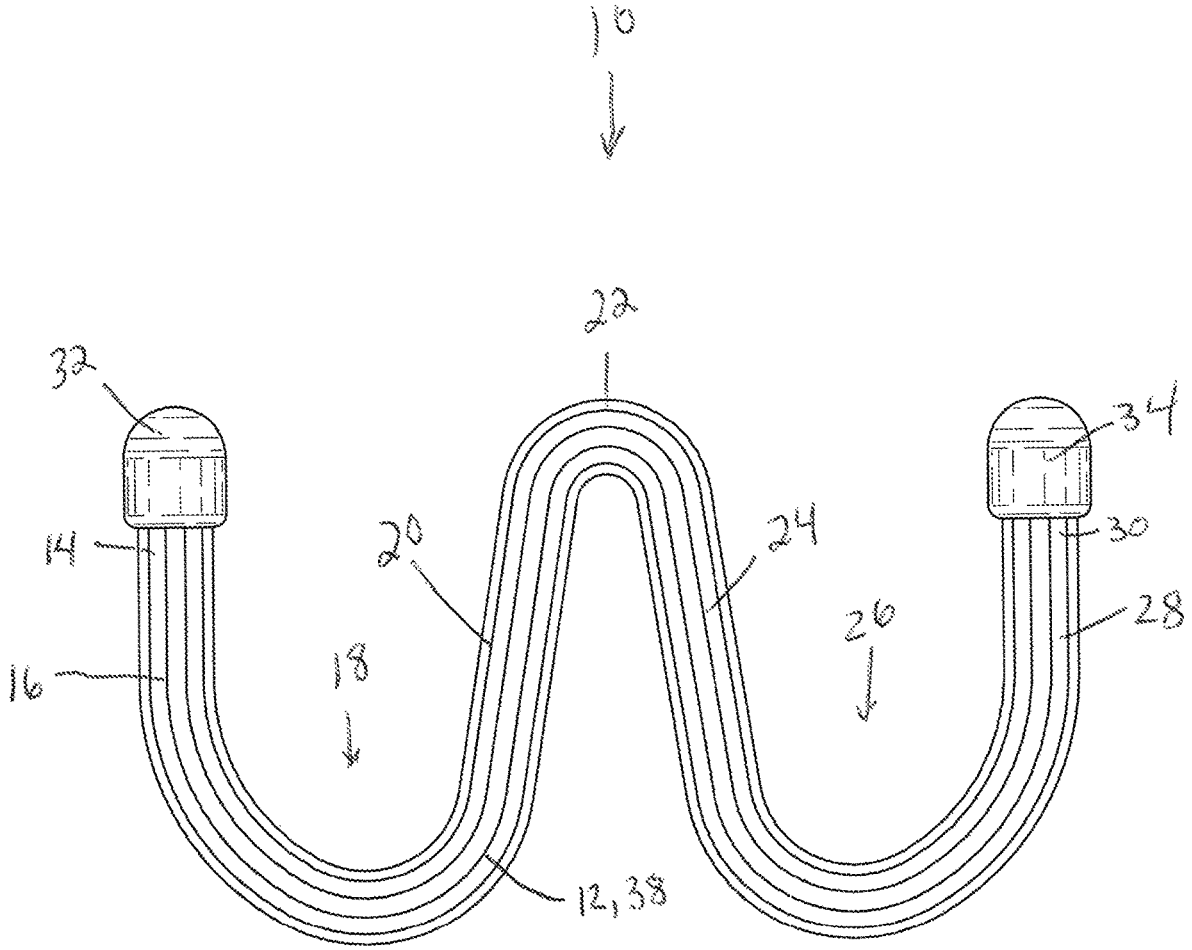
FIG. 3 is rear elevation view of the sandal transport device.
Figure 4:
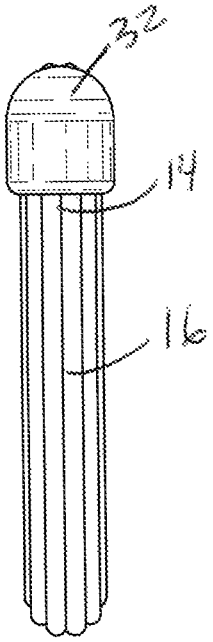
FIG. 4 is a right side elevation view of the sandal transport device.
Figure 5:
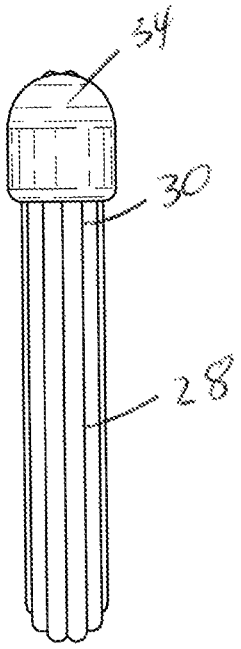
FIG. 5 is a right side elevation view of the sandal transport device.
Figure 6:
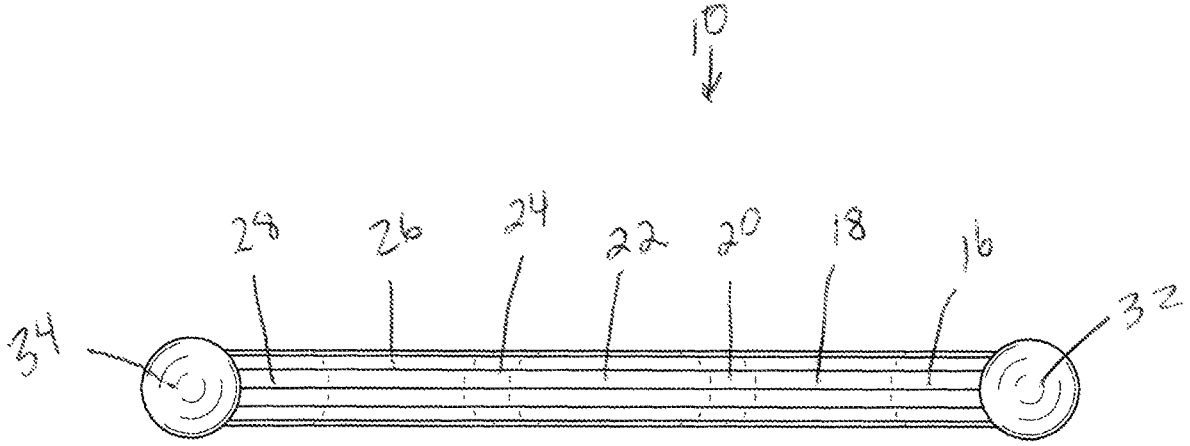
FIG. 6 is a top plan view of the sandal transport device.
Figure 7:
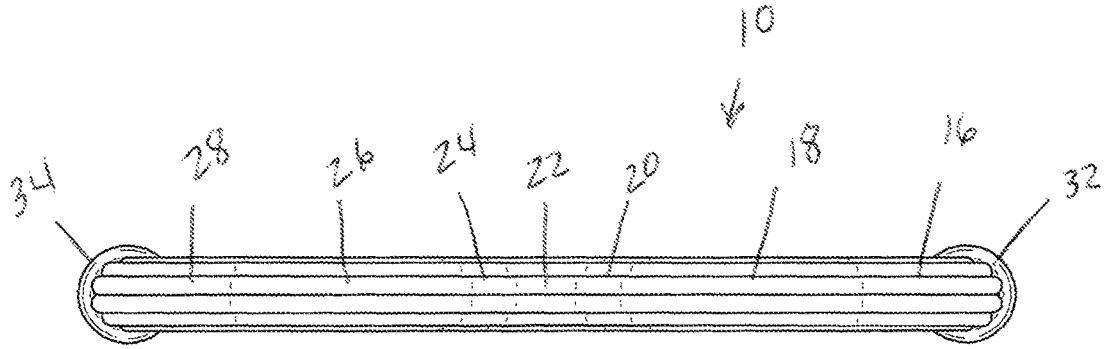
FIG. 7 is a bottom plan view of the sandal transport device.
Figure 8:
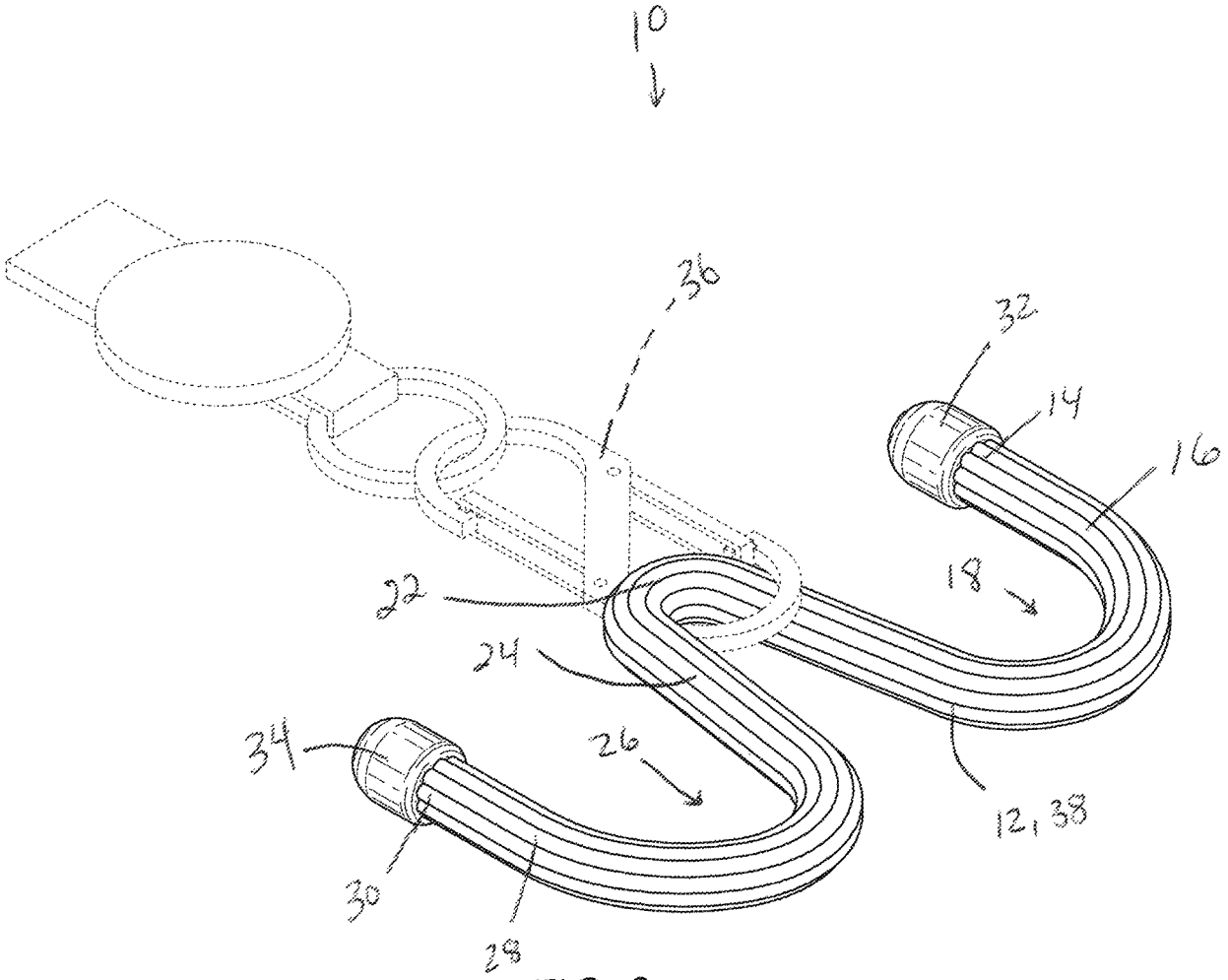
FIG. 8 is an isometric perspective top view of the sandal transport device engaged to a releasable clip, the releasable clip being shown in broken-line.

In general the sandal transport device is identified by reference numeral 10. In at least one embodiment the sandal transport device 10 is formed from a resiliently pliable elongate member 12. Following manufacture, the releasably pliable elongate member 12 has the shape of a "W". The resiliently pliable elongate member 12 is generally a one-piece, unitary component, which includes a first elevated end 14, a first angled section 16, a first trough 18, a second angled section 20, a crest 22, a third angled section 24, a second trough 26, a fourth angled section 28 and a second elevated end 30.

In at least one embodiment the first elevated end 14 has a first cap 32 and the second elevated end 30 has a second cap 34.

The resiliently pliable elongate member 12 may be formed of material selected from the group consisting of rubber, plastic, metal, wire, composite materials and combinations thereof. The resiliently pliable elongate member 12 may be formed of other materials provided that the resiliently pliable elongate member 12 retains a "W-shape" without fracture of failure during use in the engagement to, and transportation of, footwear such as sandals or flip-flops by an individual. The resiliently pliable elongate member 12 may be provided in any color or combination of colors.

In other embodiments the resiliently pliable elongate member 12 may be formed of wire which has been coated with rubber or plastic material. In another embodiment the resiliently pliable elongate member 12 may be formed of wire coated with a combination of rubber and plastic material.

In one embodiment the resiliently pliable elongate member 12 may be bent or formed in to a desired variation of the "W" shape. One example of which may be where the first angled section 16 and fourth angled section 28 have a shorter length dimension as compared to the respective second angled section 20 and third angled section 24.

In another embodiment the crest 22, first trough 18 or second trough 26 may have the same shape or a different shape. For example the shape desired for the crest 22 may be rounded, and the shape desired for the first trough 18 or second trough 26 may have a rounded point or have a tighter curved shape. The shapes selected for the crest 22, first trough 18, and/or second trough 26 may or may not be uniform, and may be of any shape as desired by an individual.

The sandal transport device 10 can be made of plastic, rubber or other materials.

In one embodiment the resiliently pliable elongate member 12 includes an exterior surface 38. The exterior surface may include texture at the preference of an individual. In some embodiments the exterior surface 38 is knurled, ribbed, grooved, lined, cross-hatched, or includes any desired shape of upwardly or downwardly extending protrusions, or other shape or types of texture. In some embodiments the texture for the exterior surface 38 will be of uniform size and shape. In other embodiments the texture for the exterior surface 38 may vary in size or shape or both size and shape, at any desired location on the resiliently pliable elongate member 12.

In at least one embodiment the length dimension for the first angled section 16, second angled section 20, third angled section 24 and fourth angled section 28 between the respective crest 22 and first trough 18 or second trough 26 is approximately three inches. In other embodiments the length dimension for the first angled section 16, second angled section 20, third angled section 24 and fourth angled section 28 may be larger or smaller than three inches dependent on the preferences of an individual and the materials selected for the resiliently pliable elongate member 12.

In at least one embodiment the resiliently pliable elongate member 12 will have a width dimension of approximately ⅛ inch. In other embodiments the width dimension for the resiliently pliable elongate member 12 may be larger or smaller than ⅛ inch dependent on the preferences of an individual and the materials selected for the resiliently pliable elongate member 12.

In at least one embodiment the resiliently pliable elongate member 12 will have a thickness dimension of approximately ⅛ inch. In other embodiments the thickness dimension for the resiliently pliable elongate member 12 may be larger or smaller than ⅛ inch dependent on the preferences of an individual and the materials selected for the resiliently pliable elongate member 12.

In at least one embodiment the resiliently pliable elongate member 12 will have a uniform thickness or width dimension. In other embodiments the thickness or width dimension for the resiliently pliable elongate member 12 may be larger or smaller at any desired location along the first angled section 16, second angled section 20, third angled section 24 and fourth angled section 28 in order to provide additional structural support for the sandal transport device 10. For example if an individual desires to transport a heavier item, then the individual may select a sandal transport device 10 having a larger thickness or width dimension for the first angled section 16, second angled section 20, third angled section 24 and/or the fourth angled section 28.

In addition, in alternative embodiments, the thickness and width dimensions for the first angled section 16, second angled section 20, third angled section 24 and fourth angled section 28 are not required to be uniform between the respective crest 22 and first trough 18 or second trough 26. The thickness and width dimension may vary at any desired location to meet the structural requirements or comfort for the sandal transport device 10.

In at least one embodiment the first trough 18 is positioned between, and at the bottom of, the first angled section 16 and second angled section 20. Additionally, the second trough 26 is positioned between, and at the bottom of, the third angled section 24 and fourth angled section 28.

In one alternative embodiment the first trough 18 is curved in a first direction which may be an upwardly facing concave curve. The second trough 26 is also curved in the first direction which may be an upwardly facing concave curve. The shape of the first trough 18 is not required to be identical in dimensions to the second trough 26, although the size and shape of the first trough 18 and the second trough 26 may in some embodiments be identical.

In at least one embodiment the resiliently pliable elongate member 12 permits an individual to customize the size and shape for the first trough 18 and second trough 26.

In a preferred embodiment the crest 22 is curved in a second direction which may have a convex curved shape. Generally the second direction for the crest 22 is opposite to the curve of the first direction for the first trough 18 and second trough 26.

In at least one alternative embodiment the first angled section 16 has a first angle relative to the first trough 18. The first angle may have a first angle dimension between vertical and forty-five degrees. The second angled section 20 has a second angle relative to the first trough 18. The second angle may have a second angle dimension between vertical and one hundred thirty five degrees. The third angled section 24 has a third angle relative to the second trough 26. The third angle may have a third angle dimension between vertical and forty-five degrees. The fourth angled section 28 has a fourth angle relative to the second trough 26. The fourth angle may have a fourth angle dimension between vertical and one hundred thirty five degrees.

In at least one embodiment the first elevated end 14 has a first cap 32 over the end or tip of the resiliently pliable elongate member 12. The second elevated end 30 also has a second cap 34 over the end or tip of the resiliently pliable elongate member 12. The first cap 32 and second cap 34 are preferably rounded and are formed of plastic or rubber material. The first cap 32 and second cap 34 preferably remove any sharp or pointed ends for the resiliently pliable elongate member 12 minimizing the risk of snagging with an item of clothing. The first cap 32 and second cap 34 also improve the comfort to an individual in the event that first cap 32 or second cap 34 contact an individual's skin.

In at least one embodiment the resiliently pliable elongate member 12 is detachably engaged to a releasable clip 36. The releasable clip 36 may be used to releasable secure the sandal transport device 10 to a clothing item during the transport of sandals or flip flops or other item while walking, in order to free up an individual's hands to operate an electronic device. The releasable clip 36 may be any type of mechanical attachment device, or formed of any metal, plastic, or composite material including the use of hook and loop materials, at the preference of an individual.

In a preferred embodiment, the sandal transport device 10 is used to releasably secure and transport a pair of sandals or flip flops of an individual. During use, an individual may pass the first elevated end 14 through a toe bridge or other strap such as a heel strap of a sandal or flip flop, whereupon the sandal or flip flop upon release will drop, and be releasably held by the first trough 18. An individual may then pass the second elevated end 30 through a toe bridge or other strap of the remaining sandal or flip flop, whereupon the sandal or flip flop upon release will drop, and be releasably held by the second trough 26.

An individual may have used the releasable clip 36 to releasably secure the crest 22 to an item of clothing prior to the engagement of the pair of sandals to the respective first elevated end 14 and first trough 18 or second elevated end 30 and second trough 26. Alternatively, and individual may engage a pair of sandals or flip flops to the respective first elevated end 14 and first trough 18 or second elevated end 30 and second trough 26 and then use the releasable clip 36 as engaged to the crest 22 to secure the sandals, flip flops or other items to an article of clothing.

In a first alternative embodiment a sandal transport device is formed of a resiliently pliable elongate member and has the shape of a "W". The resiliently pliable elongate member has a first elevated end, a first angled section, a first trough, a second angled section, a crest, a third angled section, a second trough, a fourth angled section and a second elevated end. The resiliently pliable elongate member is constructed and arranged for engagement with a releasable clip and the resiliently pliable elongate member is constructed and arranged for releasable engagement to footwear.

In a second alternative embodiment according to the first embodiment, the first elevated end has a first cap and the second elevated end has a second cap. In a third alternative embodiment according to the second embodiment, the resiliently pliable elongate member is formed of material selected from the group consisting of rubber, plastic, metal, composite materials and combinations thereof.

In a fourth alternative embodiment according to the third embodiment, the resiliently pliable elongate member has an exterior surface where the exterior surface includes at least one portion and type of texture.

In a fifth alternative embodiment according to the fourth embodiment, the releasable clip is releasably engaged to the crest.

In a sixth alternative embodiment according to the fifth embodiment, the first trough is positioned between the first angled section and the second angled section, and the second trough is positioned between the third angled section and the fourth angled section.

In a seventh alternative embodiment according to the sixth embodiment, the resiliently pliable elongate member is formed of rubber.

In an eighth alternative embodiment according to the sixth embodiment, the resiliently pliable elongate member is formed of wire coated with rubber or plastic material.

In a ninth alternative embodiment according to the sixth embodiment, the resiliently pliable elongate member is formed of wire coated with a combination of rubber and plastic material.

In a tenth alternative embodiment according to the sixth embodiment, the first trough has the shape of a rounded point, the crest has the shape of a rounded point and the second trough has the shape of a founded point.

In an eleventh alternative embodiment according to the sixth embodiment, the first trough is curved in a first direction having a first arc dimension, and the second trough is curved in the first direction.

In a twelfth alternative embodiment according to the eleventh embodiment, the second trough has the first arc dimension.

In a thirteenth alternative embodiment according to the eleventh embodiment, the crest is curved in a second direction, the second direction being opposite to the first direction.

In a fourteenth alternative embodiment according to the sixth embodiment, the first angled section has a first angle relative to the first trough, the first angle having a first angle dimension between vertical and forty-five degrees, the second angled section has a second angle relative to the first trough, the second angle has a second angle dimension between vertical and one hundred thirty five degrees, the third angled section has a third angle relative to the second trough, the third angle has a third angle dimension between vertical and forty-five degrees, and the fourth angled section has a fourth angle relative to the second trough, the fourth angle has a fourth angle dimension between vertical and one hundred thirty five degrees.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

10 sandal transport device 10

12 resiliently pliable elongate member 12

14 first elevated end 14

16 first angled section 16

18 first trough 18

20 second angled section

22 crest 22

24 third angled section 24

26 second trough 26

28 fourth angled section 28

30 second elevated end 30

32 first cap 32

34 second cap 34

36 releasable clip 36

38 exterior surface 38 of 12

I claim:

1. A sandal transport device comprising:

a resiliently pliable elongate member, said resiliently pliable elongate member having the shape of a "W", said resiliently pliable elongate member having a first elevated end, a first angled section, a first trough, a second angled section, a crest, a third angled section, a second trough, a fourth angled section and a second elevated end, a clip having a first releasable end and a second releasable end, the first releasable end being detachably connected to the resiliently pliable elongate member and the second releasable end being detachably connected to an item of clothing for wearing by a person to permit hands-free transport of footwear.

2. The sandal transport device according to claim 1, said first elevated end having a first cap and said second elevated end having a second cap.

3. The sandal transport device according to claim 2, said resiliently pliable elongate member being formed of material selected from the group consisting of rubber, plastic, metal, composite materials and combinations thereof.

4. The sandal transport device according to claim 3, said resiliently pliable elongate member having a non-smooth textured surface.

5. The sandal transport device according to claim 4, said releasable clip being releasably engaged to said crest.

6. The sandal transport device according to claim 5, wherein said first trough is positioned between said first angled section and said second angled section, and said second trough is positioned between said third angled section and said fourth angled section.

7. The sandal transport device according to claim 6, wherein said resiliently pliable elongate member is formed of rubber.

8. The sandal transport device according to claim 6, wherein said resiliently pliable elongate member is formed of wire coated with rubber or plastic material.

9. The sandal transport device according to claim 6, wherein said resiliently pliable elongate member is formed of wire coated with a combination of rubber and plastic material.

10. The sandal transport device according to claim 6, wherein said first trough has the shape of a point, said crest has the shape of a point and said second trough has the shape of a point.

11. The sandal transport device according to claim 6, wherein said first trough is curved in a first direction having a first arc dimension, and said second trough is curved in said first direction.

12. The sandal transport device according to claim 11, wherein said second trough has said first arc dimension.

13. The sandal transport device according to claim 11, wherein said crest is curved in a second direction, said second direction being opposite to said first direction.

14. The sandal transport device according to claim 6, said first angled section being angled to said second angled section, said third angled section being angled to said fourth angled section.

* * * * *